US011035161B2

(12) United States Patent
Schabenberger et al.

(10) Patent No.: US 11,035,161 B2
(45) Date of Patent: Jun. 15, 2021

(54) HINGE FOR A HINGED OPENING OF A VEHICLE

(71) Applicants: Audi AG, Ingolstadt (DE); PRINZ Kinematics GmbH, Stromberg (DE)

(72) Inventors: Richard Schabenberger, Münchsmünster (DE); Paula Wirth, Stromberg (DE)

(73) Assignees: AUDI AG, Ingolstadt (DE); PRINZ Kinematics GmbH, Stromberg (DE)

( * ) Notice: Subject to any disclaimer, the term of this patent is extended or adjusted under 35 U.S.C. 154(b) by 0 days.

(21) Appl. No.: 16/609,860

(22) PCT Filed: May 4, 2018

(86) PCT No.: PCT/EP2018/061477

§ 371 (c)(1),
(2) Date: Oct. 31, 2019

(87) PCT Pub. No.: WO2018/202838

PCT Pub. Date: Nov. 8, 2018

(65) Prior Publication Data

US 2020/0087959 A1 Mar. 19, 2020

(30) Foreign Application Priority Data

May 5, 2017 (DE) ..... 10 2017 004 342.6

(51) Int. Cl.
*E05D 7/00* (2006.01)
*E05D 5/10* (2006.01)
(Continued)

(52) U.S. Cl.
CPC ..... *E05D 7/0045* (2013.01); *E05D 3/02* (2013.01); *E05D 5/10* (2013.01); *E05D 2005/102* (2013.01); *E05D 2007/0484* (2013.01)

(58) Field of Classification Search
CPC ..... E05D 7/0045; E05D 2007/0072; E05D 2007/0484; E05D 5/10; E05D 2005/102; E05D 2005/122; E05D 2005/124
See application file for complete search history.

(56) References Cited

U.S. PATENT DOCUMENTS 1,892,943 A * 1/1933 Geyer ..... F16F 1/3732 403/220
4,441,835 A * 4/1984 Davis ..... E05D 15/466 403/24

(Continued)

FOREIGN PATENT DOCUMENTS

DE 10 2009 022 939 A1 12/2010
EP 3150786 A1 4/2017

OTHER PUBLICATIONS

International Search Report and Written Opinion of the International Searching Authority directed to related International Patent Application No. PCT/EP2018/061477, dated Aug. 3, 2018, with attached English-language translation; 13 pages.

*Primary Examiner* — Jeffrey O'Brien
(74) *Attorney, Agent, or Firm* — Sterne, Kessler, Goldstein & Fox P.L.L.C.

(57) ABSTRACT

A hinge for a hinged opening of a vehicle includes a first hinge part and a second hinge part which are connected to one another via an axis of rotation so as to be movable relative to one another. The first hinge part has a slot and the second hinge part has a fitting hole. A screw is received through the slot of the first hinge part and fitting hole of the second hinge part. A shaped nut clamps the first hinge part and the second hinge part against the screw. The shaped nut forms a step that includes a first part received in the slot and a second part protruding from the first hinge part and resting on an edge of the slot.

7 Claims, 2 Drawing Sheets

(51) Int. Cl.
*E05D 7/04* (2006.01)
*E05D 3/02* (2006.01)

(56) References Cited

U.S. PATENT DOCUMENTS 5,074,609 A * 12/1991 Dear ..... E05D 7/0423 296/76
5,133,109 A * 7/1992 Mariani ..... E05D 7/0407 16/238
5,584,099 A * 12/1996 Westerdale ..... E05D 5/062 16/235
5,967,586 A * 10/1999 Duffy ..... E05D 7/0045 16/235
6,701,572 B2 * 3/2004 Bechthold ..... E05D 7/0045 16/235
7,594,301 B2 * 9/2009 Krajenke ..... E05D 7/0423 16/235
8,595,901 B1 * 12/2013 Shaw ..... E05D 5/062 16/235
2018/0355646 A1 * 12/2018 Revelis ..... E05D 3/02

* cited by examiner

HINGE FOR A HINGED OPENING OF A VEHICLE

TECHNICAL FIELD

The present invention relates to a hinge for a hinged opening of a vehicle according to the preamble of claim 1 and to a hinged opening of a vehicle comprising at least one hinge of this kind.

BACKGROUND

Hinges for hinged openings of vehicles are known in numerous variations and include a first hinge part and a second hinge part, which are connected to one another via an axis of rotation so as to be movable relative to one another. The first hinge part has a slot and the second hinge part has a fitting hole through which a screw is guided, which is clamped by a shaped nut.

From DE 10 2009 022 939 A1 a generic hinge for a front hinged opening of a vehicle is known, which has a lower hinge part and an upper hinge part, which are connected via a clamping screw with each other. A device for adjusting the height of the front hinged opening comprises a hole in a hinge part and a slot in the other hinge part through which the clamping screw is passed and after tightening a nut the clamping screw can be clamped such that, when using a bushing, the height adjustment can be fixed and the relative mobility of the hinge parts are guaranteed.

SUMMARY OF INVENTION

The object of the present invention is to provide a hinge for a hinged opening of a vehicle and a hinged opening of a vehicle comprising at least one hinge of this kind, which has a reduced length of a hinge axis with the same length of a nut thread.

According to embodiments of the present invention the object is achieved by providing a hinge for a hinged opening of a vehicle with the features described herein and by a hinged opening of a vehicle with the features described herein. Advantageous embodiments and further developments of the invention are specified herein.

In order to provide a hinge for a hinged opening of a vehicle, which has a reduced length of a hinge axis with the same length of a nut thread, a shaped nut forms a step, wherein a first part of the step is inserted into a slot and a second part of the step protrudes from a first hinge part and rests on one edge of the slot.

In the following, a hinge is understood to mean an assembly having a first hinge part and a second hinge part, which are connected to one another via an axis of rotation so as to be movable relative to one another. The first hinge part has the slot and the second hinge part has a fitting hole through which a screw is guided. The screw is clamped by the shaped nut. In this case, the nut in the tightened state fixes, on the one hand, the position of the screw and thereby the position of the rotation axis in the slot and, on the other hand, it allows a relative rotational movement between the two hinge parts about the axis of rotation of the screw. Tolerance compensation is possible through the slot between two vehicle parts connected to the hinge parts. For example, an installation position of the hinged opening of a vehicle on the body can be changed or adjusted through the slot.

In addition, a hinged opening of a vehicle comprising at least one hinge of this kind is proposed.

Advantageously, the thread of the shaped nut can be at least partially embedded with the first part of the step in the slot, such that the usable thread length of the nut thread remains the same and the second part of the step, which protrudes from the first hinge part, can be shortened. Advantageously, a length of the screw, which is guided through the slot of the first hinge part and the fitting hole of the second hinge part and tightened by the shaped nut, can be reduced. By nesting the shaped nut and the slot and the length reduction of the screw and of the second part of the shaped nut achieved thereby, said second part protruding from the first hinge part, the space occupied by the hinge according to an embodiment of the present invention can be reduced in an advantageous manner. As a result, damage to body components by the hinge according to the invention can advantageously be reduced or completely prevented in an accident situation in bottlenecks.

In an advantageous embodiment of the hinge according to the present invention, the first part of the shaped nut can form a pin with an internal thread. In addition, the internal thread can completely penetrate the shaped nut. As a result, the usual usable thread length of the shaped nut can be achieved in an advantageous manner.

In a further advantageous embodiment of the hinge according to the present invention, the shaped nut can be mounted so as to be longitudinally movable along at least one guide element along the slot on the first hinge part. Advantageously, the guide element can form a rotation lock. By preventing rotation, the screw can be screwed into the shaped nut without another counter-holding tool. In addition, the screw can be guided with the guided shaped nut in the slot.

In a further advantageous embodiment of the hinge according to the present invention, the at least one guide element can be designed as a projection which runs at least next to a side edge of the slot and which guides a flattened region of the shaped nut, said region being adjacent to the projection. In this case, the shaped nut can advantageously be guided outside on a surface of the first hinge part. The at least one projection can preferably be introduced as a caulking next to the slot into the first hinge part.

In an alternative embodiment of the hinge according to the present invention, at least one side wall of the slot can form the at least one guide element and guide a corresponding flattened region of the first part of the shaped nut embedded in the slot. Here, the shaped nut can be guided, locked in rotation, inside the slot of the first hinge in an advantageous manner.

In a further advantageous embodiment of the hinge according to the present invention, the screw may have an upset end portion. By the upset end portion, an unintentional complete release of the clamping connection between the screw and the shaped nut and also a deliberate separation of the shaped nut and the screw can be prevented in an advantageous manner. As a result, a removal of the screw from the slot and the fitting hole can be prevented in an advantageous manner, such that the hinged opening connected to the vehicle body via the hinge according to the invention can be prevented from being separated from the vehicle body. Thereby, an effective theft protection can be implemented.

BRIEF DESCRIPTION OF FIGURES

Embodiments of the present invention are illustrated in the drawings and are explained in more detail in the following description. In the drawing, same reference numerals designate components that perform the same or analog functions. In the drawings.

DETAILED DESCRIPTION OF FIGURES

Figure 1:
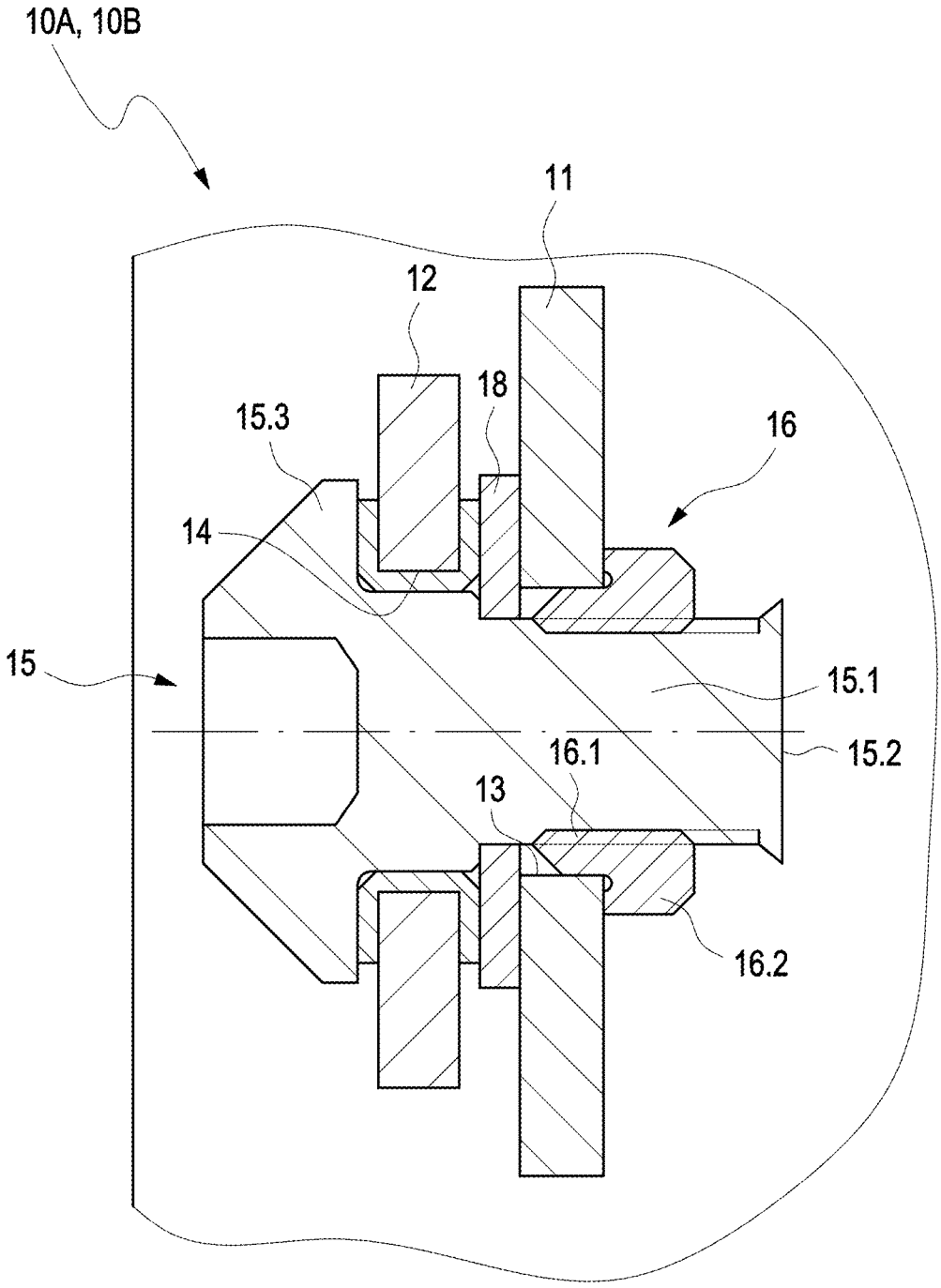
FIG. 1 shows a schematic sectional view of an exemplary embodiment of a hinge for a hinged opening of a vehicle according to an embodiment of the present invention.
Figure 2:
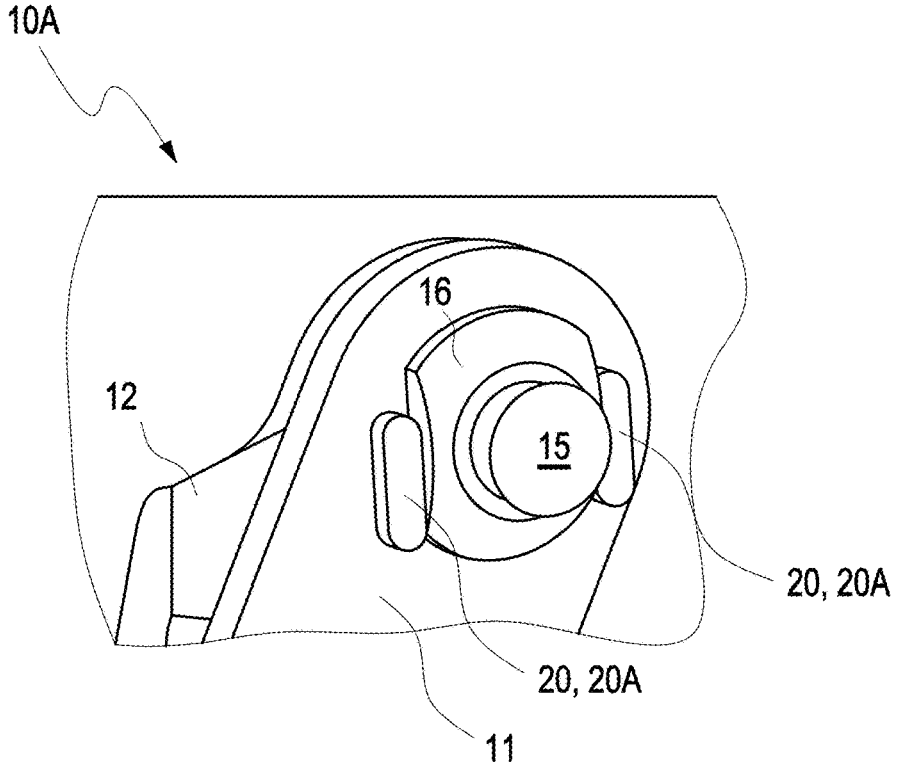
FIG. 2 shows a schematic perspective view of the hinge according to an embodiment of the present invention from FIG. 1 with a first exemplary embodiment of at least one guide element.
Figure 3:
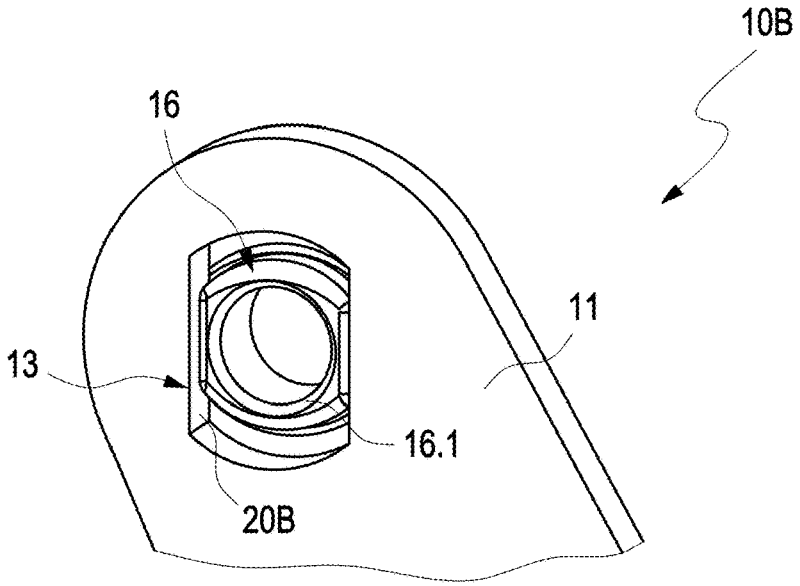
FIG. 3 shows a schematic perspective illustration of the hinge according to an embodiment of the present invention from FIG. 1 with a second exemplary embodiment of the at least one guide element.

As shown in FIGS. 1 to 3, a hinge 10A, 10B for a hinged opening of a vehicle includes a first hinge part 11 and a second hinge part 12, which are connected to one another via an axis of rotation so as to be movable relative to one another. The first hinge part 11 has a slot 13, and the second hinge part 12 has a fitting hole 14. Through the slot 13 and through the fitting hole 14, a screw 15 is guided, which is clamped by a shaped nut 16.

According to various embodiments of the present invention, the shaped nut 16 forms a step, wherein a first part 16.1 of the shaped nut 16 is inserted into the slot 13 and a second part 16.2 of the shaped nut 16 protrudes from the first hinge part 11 and rests on an edge of the slot 13.

As shown in FIG. 1, the first hinge part 11 and the second hinge part 12 have mutually facing surfaces, between which a washer 18 is arranged. In the illustrated exemplary embodiments, the screw 15 is designed as a stepped screw, which includes a larger diameter in a first portion guided in the fitting hole 14 than a threaded portion 15.1 guided in the slot 13.

The two hinge parts 11, 12 are clamped between the screw head 15.3 and the shaped nut 16 such that the position of the screw and thereby the position of the axis of rotation is fixed in the slot but a relative rotational movement between the hinge parts 11, 12 is still possible. The screw 15 has an upset end portion 15.2. Here, the shaped nut 16 and the two hinge parts 11, 12 are arranged between the screw head 15.3 and the upset end portion 15.2 of the screw 15. As a result, disengagement of the hinged opening of a vehicle connected to a hinge part 11, 12 is made more difficult by a body component connected to the other hinge part 11, 12, and an effective theft protection is implemented. In addition, an unwanted complete release of the screw can be avoided in an advantageous manner. Between the upset end portion 15.2 and the shaped nut 16, the threaded portion 15.1 has a sufficient clearance to allow the release of the connection, which allows a displacement of the screw 15 and the shaped nut 16 along the slot 13.

As shown in FIGS. 1 to 3, the first part 16.1 of the shaped nut 16 forms a pin with an internal thread, which completely penetrates the shaped nut 16. Thereby, the expansion of the shaped nut 16 can be reduced along the axis of rotation maintaining the same thread length. The shaped nut 16 completely covers the slot 13 in the illustrated exemplary embodiment. A further embodiment is also conceivable in which the shaped nut 16 covers only the width of the slot 13 but not the entire length of the slot 13.

As shown in FIGS. 2 and 3, the shaped nut 16 is mounted so as to be longitudinally movable along at least one guide element 20 along the slot 13 on the first hinge part 11, wherein the guide element 20 forms a rotation lock.

The first embodiment of the hinge 10A according to an embodiment of the present invention illustrated in FIG. 2 differs from the embodiment of the hinge 10*b* shown in FIG. 3 by the at least one guide member 20.

As shown in FIG. 2, the at least one guide element 20 is designed as a projection 20A which runs at least next to a side edge of the slot 13 and which guides a flattened region of the shaped nut 16, said region being adjacent to the projection 20A. In the illustrated first exemplary embodiment, the second part 16.2 of the shaped nut 16 resting on the outside of the first hinge part 11 is disposed between two projections 20A, each extending along a side edge of the slot 13. The projections 20A can be easily inserted into the first hinge part 11 by caulking.

As shown in FIG. 3, at least one side wall 20B of the slot 13 forms the at least one guide element 20 in the illustrated second exemplary embodiment and guides a flattened region of the first part 16.1 of the shaped nut 16 embedded in the slot 13. In the illustrated second exemplary embodiment, both side walls 20B of the slot 13 each guide a flattened region of the first part 16.1 of the shaped nut 16 embedded in the slot 13, such that the shaped nut 16 is guided in the slot 13 in a manner locked against rotation.

LIST OF REFERENCE NUMBERS

10A, 10B Hinge
11 First hinge part
12 Second hinge part
13 Slot
14 Fitting hole
15 Screw
15.1 Thread section
15.2 Compressed end area
15.3 Screw head
16 Shaped nut
16.1 First part
16.2 Second part
18 Washer
20 Guide element
20A Projection
20B Sidewall

The invention claimed is:

1. A hinge for a hinged opening of a vehicle, comprising:

a first hinge part having a slot;

a second hinge part having a fitting hole;

a screw received through the slot of the first hinge part and the fitting hole of the second hinge part such that the first hinge part and the second hinge part are rotatably connected about the screw;

a shaped nut clamping the first hinge part and the second hinge part against the screw; and at least one guide element having an elongated projection disposed adjacent to a side edge of the slot of the first hinge part and configured to lock the shaped nut from rotation, wherein the first hinge part and the second hinge part are movable relative to one another about an axis of rotation defined by the screw, wherein the shaped nut comprises a first part embedded in the slot of the first hinge part and a second part protruding from the first hinge part and resting on an edge of the slot of the first hinge part, and wherein the elongated projection extends along the side edge of the slot of the first hinge part, and the shaped nut comprises a flattened region disposed adjacent to the elongated projection such that the elongated projection guides the flattened region of the shaped nut in a longitudinal direction.

2. The hinge according to claim 1, wherein the first part of the shaped nut comprises a pin with an internal thread.

3. The hinge according to claim 2, wherein the internal thread extends through the shaped nut.

4. The hinge according to claim 1, wherein the at least one guide element is configured to lock the shaped nut from rotation.

5. The hinge according to claim 1, wherein the screw has a compressed end region.

6. The hinge according to claim 1, wherein the screw includes a screw head, a compressed end, a threaded portion extending between the screw head and the compressed end, and the threaded portion extends beyond an end of the second part of the shaped nut by a clearance corresponding to an axial length of the first hinge part such that the shaped nut is configured to be released from clamping the first hinge part and second hinge part while remaining on the threaded portion.

7. A hinged opening of a vehicle comprising:

at least one hinge, wherein each hinge comprises:

a first hinge part having a slot;

a second hinge part having a fitting hole;

a screw received through the slot of the first hinge part and the fitting hole of the second hinge part such that the first hinge part and the second hinge part are rotatably connected about the screw;

a shaped nut clamping the first hinge part and the second hinge part against the screw; and at least one guide element having an elongated projection disposed adjacent to a side edge of the slot of the first hinge part and configured to lock the shaped nut from rotation, wherein the first hinge part and the second hinge part are movable relative to one another about an axis of rotation defined by the screw, wherein the shaped nut comprises a first part embedded in the slot of the first hinge part and a second part protruding from the first hinge part and resting on an edge of the slot of the first hinge part, and wherein the elongated projection extends along the side edge of the slot of the first hinge part and the shaped nut comprises a flattened region disposed adjacent to the elongated projection such that the elongated projection guides the flattened region of the shaped nut in a longitudinal direction.

* * * * *